US005939019A

United States Patent [19]

Stein et al.

[11] Patent Number: 5,939,019

[45] Date of Patent: Aug. 17, 1999

[54] STEEL FOR FOUNDRY ROLL SHELLS

[76] Inventors: Gerald Stein, Kamperfeld 12a, D-45133, Essen; Lother Hentz, Hattinger Str. 614, D-44869, Bochum; Heinz-Albert Weber, Herzog-Adolf-Str. 24, D-046483, Wesel; Hermann-Josef Skotz, Thielen Platz 3, D-45147, Essen; Udo Riepe, Amtsstr. 11, D-58239, Schwerte, all of Germany

[21] Appl. No.: 09/174,638

[22] Filed: Oct. 19, 1998

Related U.S. Application Data

[63] Continuation of application No. 09/047,756, Mar. 25, 1998, abandoned.

[51] Int. Cl.[6] ..... C22C 38/44; C22C 38/46

[52] U.S. Cl. ..... 420/109

[58] Field of Search ..... 420/109

[56] References Cited

U.S. PATENT DOCUMENTS

| | | | |
|---|---|---|---|
| 4,420,335 | 12/1983 | Takagi et al. | 75/124 |
| 5,407,635 | 4/1995 | Iseda et al. | 420/110 |
| 5,695,576 | 12/1997 | Beguinot | 420/109 |

FOREIGN PATENT DOCUMENTS

| | | | |
|---|---|---|---|
| 0 247 415 | 12/1987 | European Pat. Off. . | |
| 162 908 | 4/1949 | Germany . | |
| 898 316 | 7/1949 | Germany . | |
| XP-002072219 | 2/1975 | Japan | 38/18 |
| 55-125261 | 9/1980 | Japan | 38/48 |

*Primary Examiner*—Deborah Yee

[57] ABSTRACT

The invention relates to a steel for foundry roll shells comprising (in % by weight)
0.1 to 0.4% carbon
0.1 to 0.8% silicon
0.2 to 0.7% manganese
2.0 to 2.9% chromium
0.2 to 0.9% nickel
0.5 to 1.2% molybdenum
0.3 to 0.7% vanadium
0.15 to 0.3% columbium
0.10 to 0.3% nitrogen
balance iron and incidental impurities.

3 Claims, No Drawings

STEEL FOR FOUNDRY ROLL SHELLS

This application is a continuation of Ser. No. 09/047,756 filed Mar. 25, 1998 now abandoned.

BACKGROUND OF THE INVENTION

This invention relates to a steel for foundry roll shells, especially for aluminum casting machines.

It has become increasingly common to use scrap for the production of semi-finished aluminum products. For this purpose the scrap is melted, cast and hot rolled. The casting of the aluminum melt is performed in such way that it is poured into the gap between two cooled foundry rolls which are pivoted on horizontal axis. Upon contact with the cooled foundry rolls the aluminium melt solidifies and is shaped by the rotating foundry rolls.

Foundry rolls generally consist of an axis and a foundry roll shell shrinked or mounted thereon. The material used for foundry roll shells must meet certain requirements. One requirement is a low thermal expansion coefficient to ensure an exact positioning of the shell on the axis even at elevated temperatures. Furthermore, the material used for foundry roll shells must be of high hardness and, in addition, show good ductility at elevated temperatures up to 750° C. After prolonged time of operation a network of cracks is formed due to thermal strain. The aim is to prolong the time until unavoidable formation of cracks happens by using a shell of optimum quality. It is thus essential for materials used for foundry roll shells to have a high resistance against hot cracks.

Up to now steels having chemical compositions as described in table 1 have been used for foundry roll shells. All percentages are % by weight.

| | Alloying elements in %-by weight | | | | | |
|---|---|---|---|---|---|---|
| Steel | C | Mn | Cr | Ni | Mo | V |
| P911 | 0.53 | 0.47 | 2.05 | 0.50 | 1.03 | 0.35 |
| P912 | 0.53 | 0.50 | 1.13 | 0.48 | 0.48 | 0.15 |
| P914 | 0.16 | 0.96 | 1.40 | 0.20 | 0.90 | 0.26 |
| P916 | 0.32 | 0.30 | 2.95 | 0.20 | 2.80 | 0.20 |
| P917 | 0.30 | 0.55 | 2.55 | 0.50 | 1.10 | 0.60 |
| P918 | 0.18 | 0.50 | 5.00 | 0.15 | 1.10 | 0.90 |

The steels listed in table 1 are chromium-, nickel-, molybdenum- and vanadium-alloyed steels having a carbon content of 0.16% and higher. By use of these steels it was possible to adjust the desired properties of the foundry roll shells in a satisfactory manner.

It is one object of the present invention to further improve the steels presently known in the art for use in foundry roll shells so that the foundry roll shells exhibit an improved resistance against mechanical wear and against hot cracks and thereby have an extended life time.

SUMMARY OF THE INVENTION

According to the present invention this object is solved by a steel for foundry roll shells having (in % by weight)

0.1 to 0.4% carbon
0.1 to 0.8% silicon
0.2 to 0.7% manganese
2.0 to 2.9% chromium
0.2 to 0.9% nickel
0.5 to 1.2% molybdenum
0.3 to 0.7% vanadium 0.15 to 0.3% columbium
0.10 to 0.3% nitrogen
balance iron and incidental impurities.

According to a preferred embodiment of the present invention the composition of the alloy is:

0.25 to 0.36% carbon
0.10 to 0.80% silicon
0.20 to 0.70% manganese
2.00 to 2.65% chromium
0.25 to 0.75% nickel
0.50 to 1.10% molybdenum
0.30 to 0.70% vanadium
0.15 to 0.30% columbium
0.10 to 0.30% nitrogen
balance iron and incidental impurities A further preferred composition of the material according to the invention is as follows:

0.10 to 0.20% carbon
0.10 to 0.80% silicon
0.20 to 0.70% manganese
2.00 to 2.65% chromium
0.25 to 0.75% nickel
0.50 to 1.10% molybdenum
0.30 to 0.70% vanadium
0.15 to 0.30% columbium
0.10 to 0.30% nitrogen
balance iron and incidental impurities The steel may also contain up to 0.1% aluminum and/or up to 1.0% tungsten.

The steel according to the invention differs from the materials previously used for foundry roll shells in that it additionally contains columbium in an amount of 0.15 to 0.30% by weight. Columbium combines with the nitrogen which is contained in an amount of 0.1 to 0.3% in the steel to form columbium nitride. Columbium nitride particles precipitate in a finely dispersed manner, resulting in the formation of a fine-grained structure, which is a prerequisite for good ductility of the material and for reducing the tendency of forming hot cracks.

Tests that have been conducted using the material according to the present invention showed that the material not only has the required hardness necessary for minimizing wear but also sufficient ductility up to the range of the operating temperature of the foundry rolls of 600 to 750° C.

Foundry roll shells made of a steel according to the present invention are expexially useful for foundry machines for continuous casting aluminum semi finished products.

What is claimed is:

1. Steel for foundry roll shell comprising (in % by weight)

0.1 to 0.4% carbon
0.1 to 0.8% silicon
0.2 to 0.7% manganese
2.0 to 2.9% chromium
0.2 to 0.9% nickel
0.5 to 1.2% molybdenum
0.3 to 0.7% vanadium
0.15 to 0.3% columbium
0.10 to 0.3% nitrogen
balance iron and incidental impurities.

2. Steel according to claim 1 comprising (in % by weight)

0.25 to 0.36% carbon
0.10 to 0.80% silicon
0.20 to 0.70% manganese
2.00 to 2.65% chromium
0.25 to 0.75% nickel
0.50 to 1.10% molybdenum
0.30 to 0.70% vanadium 0.15 to 0.30% columbium
0.10 to 0.3 % nitrogen
balance iron and incidental impurities.

3. Steel according to claim 1, comprising in % by weight
0.10 to 0.20% carbon
0.10 to 0.80% silicon
0.20 to 0.70% manganese
2.00 to 2.65% chromium
0.25 to 0.75% nickel
0.50 to 1.10% molybdenum
0.30 to 0.70% vanadium
0.15 to 0.30% columbium
0.10 to 0.30% nitrogen
balance iron and incidental impurities.

* * * * *

UNITED STATES PATENT AND TRADEMARK OFFICE

CERTIFICATE OF CORRECTION

PATENT NO : 5,939,019

DATED : August 17, 1999

INVENTOR(S) : Stein et al.

It is certified that error appears in the above-identified patent and that said Letters Patent is hereby corrected as shown below:

Col. 2, Line 43 In chart delete "P916" and insert --P915--

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*